US008985728B2

(12) United States Patent
Nagahara

(10) Patent No.: US 8,985,728 B2
(45) Date of Patent: Mar. 24, 2015

(54) PRINTING APPARATUS

(71) Applicant: Seiko Epson Corporation, Tokyo (JP)

(72) Inventor: Atsushi Nagahara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,756

(22) Filed: Mar. 24, 2014

(65) Prior Publication Data

US 2014/0292898 A1 Oct. 2, 2014

(30) Foreign Application Priority Data

Mar. 28, 2013 (JP) ..... 2013-068836

(51) Int. Cl.
*B41J 29/38* (2006.01)
*B41J 2/01* (2006.01)
*B41J 3/407* (2006.01)

(52) U.S. Cl.
CPC ..... *B41J 3/4075* (2013.01)
USPC ..... 347/16; 347/101

(58) Field of Classification Search
None
See application file for complete search history.

(56) References Cited

U.S. PATENT DOCUMENTS 7,616,216 B2 11/2009 Yamakado et al.
2004/0226467 A1 * 11/2004 Underwood et al. ..... 101/484

FOREIGN PATENT DOCUMENTS

JP 61-272178 12/1986
JP 2007-172164 7/2007

* cited by examiner

*Primary Examiner* — Geoffrey Mruk
(74) *Attorney, Agent, or Firm* — Workman Nydegger

(57) ABSTRACT

A printing apparatus includes a printing section that forms a plurality of unit images on a print medium and forms marks that are references for specifying positions of the unit images on the print medium, in which the marks include a different-color image capable of being visually recognized of which a color is different from a background color of the marks.

5 Claims, 6 Drawing Sheets

FIG. 5

| WHICH INFORMATION IS DISPLAYED ON EYE MARK? |
| --- |
| ◉ 1. ROW NUMBER |
| ○ 2. LABEL NUMBER |
| ○ 3. LABEL POSITION |

FIG. 6

| HOW IS COLOR OF INFORMATION IN EYE MARK CHANGED? |
| --- |
| ◉ 1. a AMONG VALUES OF Lab IS CHANGED TO MAXIMUM VALUE |
| ○ 2. a AMONG VALUES OF Lab IS CHANGED TO MINIMUM VALUE |
| ○ 3. b AMONG VALUES OF Lab IS CHANGED TO MAXIMUM VALUE |
| ○ 4. b AMONG VALUES OF Lab IS CHANGED TO MINIMUM VALUE |

PRINTING APPARATUS

BACKGROUND

1. Technical Field

The present invention relates to a printing apparatus.

2. Related Art

A printing apparatus having a printing section that forms a plurality of unit images such as a label on a print medium such as a rolled sheet is already well known. As the printing apparatus, an ink jet printer may be exemplified.

JP-A-61-272178 is an example of the related art.

However, sometimes, a user desires that the user assist information is printed on the rolled sheet S. For example, the wanted information regarding the unit image on which the user focuses is the following: a unit image number, a unit image row number, or how many meters that the unit image is positioned away.

However, unwanted situations for user may occur depending where the information is printed. Therefore, a new strategy is requested that offers high user convenience.

SUMMARY

An advantage of some aspects of the invention is to provide a printing apparatus having high convenience for a user.

A printing apparatus according to an aspect of the invention including a printing section that forms a plurality of unit images on a print medium and forms marks that are references for specifying positions of the unit images on the print medium, in which the marks include a different-color image capable of being visually recognized of which a color is different from a background color of the marks.

Other features of the invention will be apparent from this description and accompanying drawings.

BRIEF DESCRIPTION OF THE DRAWINGS

The invention will be described with reference to the accompanying drawings, wherein like numbers reference like elements.

FIG. 5 is a view illustrating an example of a user interface screen according to selection of relevant information.

FIG. 6 is a view illustrating an example of a user interface screen according to designation of a color.

DESCRIPTION OF EXEMPLARY EMBODIMENTS

The following matters will be made clear by this description and the accompanying drawings.

According to an aspect of the invention, there is provided a printing apparatus including a printing section that forms a plurality of unit images on a print medium and forms marks that are references for specifying positions of the unit images on the print medium, in which the marks include a different-color image capable of being visually recognized of which a color is different from a background color of the marks.

In this case, according to the printing apparatus, it is possible to realize the printing apparatus having high user convenience.

Further, in the printing apparatus, the different-color image may be relevant information relating to the unit images.

The user can appropriately refer to the relevant information relating to the unit images, and thus it is possible to improve user convenience.

Further, the printing apparatus may further include a relevant information selecting section that makes a user select the relevant information among candidates of a plurality of pieces of relevant information, in which the printing section may form the marks including the relevant information that is selected by the user as the different-color image on the print medium.

In this case, it is possible to further improve the convenience for the user.

Further, in the printing apparatus, in colors of the background color and the different-color image, L values may be the same as each other, and at least one of an a value and a b value may be different from each other, in a space of Lab color.

In this case, it is possible to further reliably suppress occurrence of false detection of the marks.

Further, the printing apparatus may include: a color designation section that makes the user designate at least one of the a value and the b value, in which the printing section may form the marks including the different-color image of which the color is selected by the user on the print medium.

In this case, it is possible to further reliably suppress occurrence of false detection of the marks.

Schematic Configuration Example of Printer 1

Figure 1:
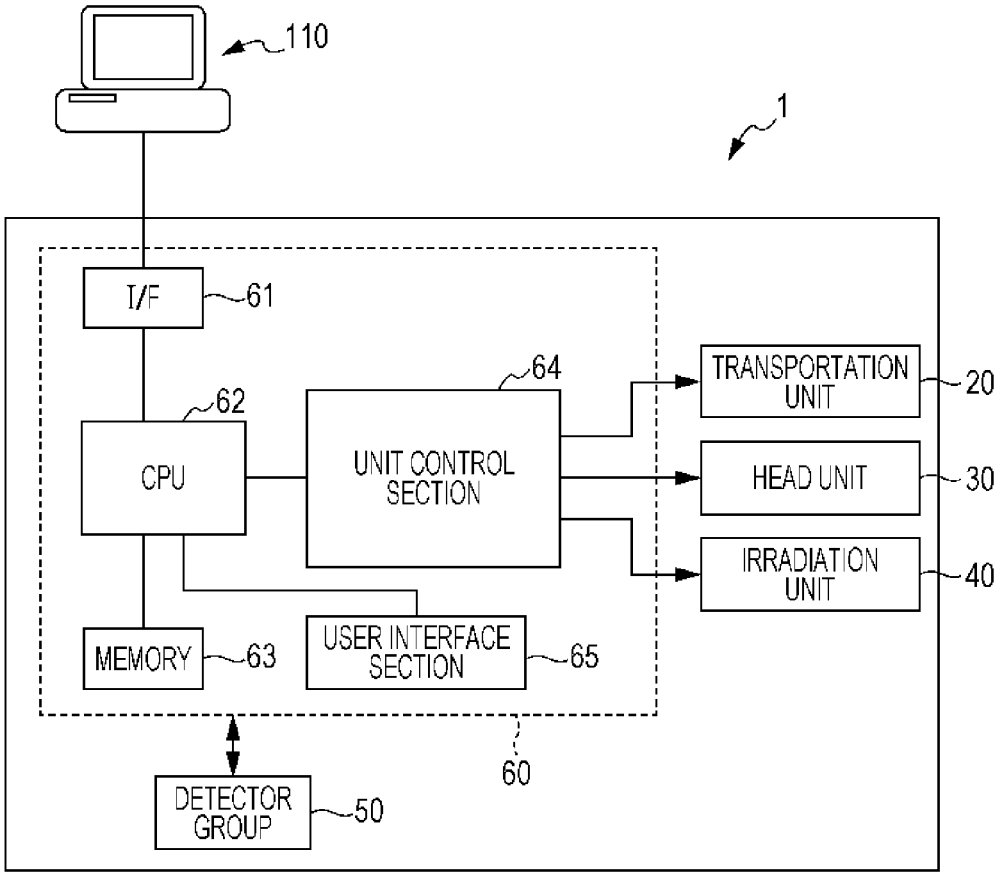
FIG. 1 is a block diagram of an overall configuration of a printer.
Figure 2:
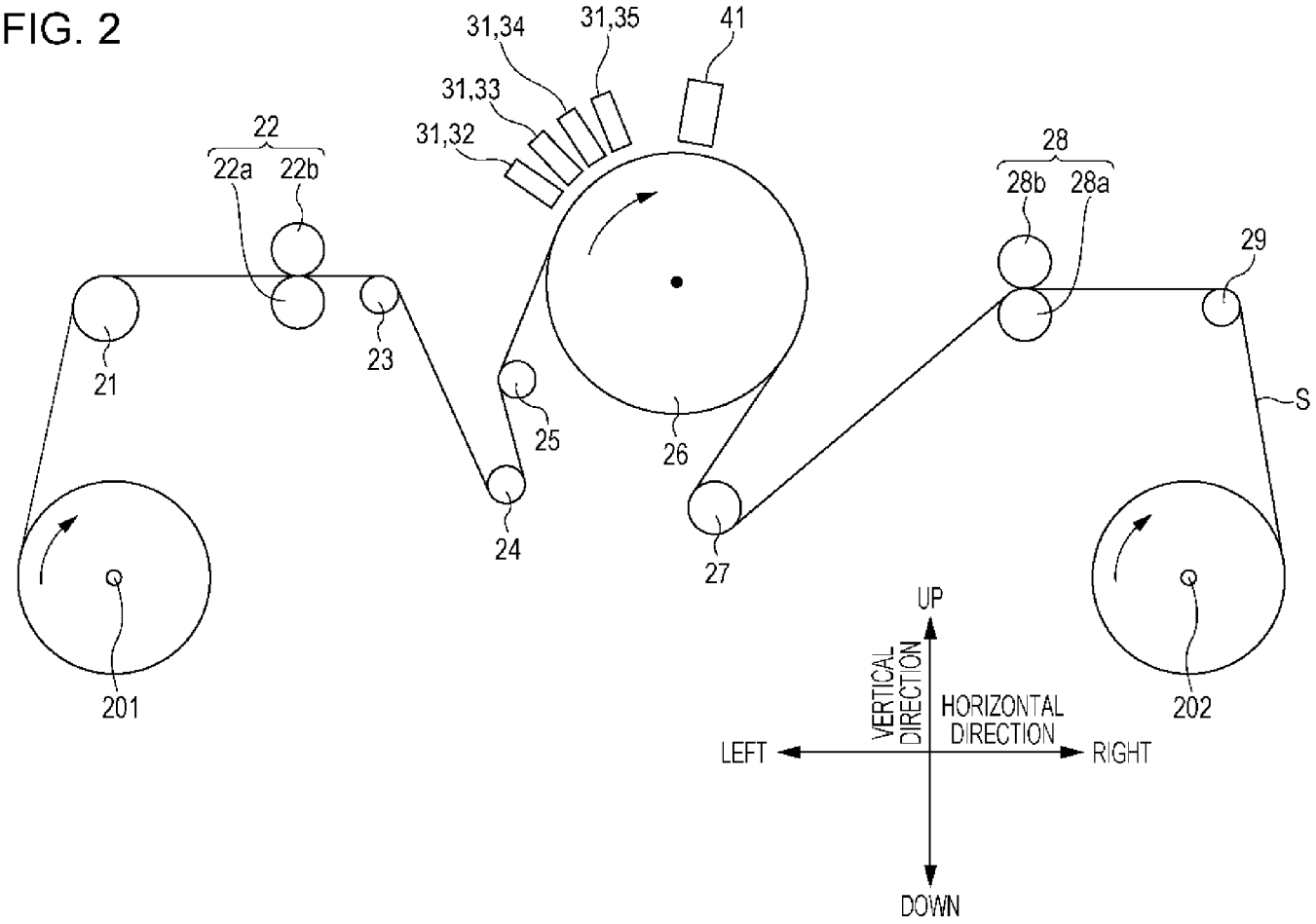
FIG. 2 is a schematic view of a transportation path including a printing area.

FIG. 1 is a block diagram of an overall configuration of an ink jet printer (hereinafter, simply, referred to as a printer 1) as an example of a printing apparatus. Furthermore, FIG. 2 is a schematic view of a transportation path including a printing area.

The printer 1 is the printing apparatus for printing an image on a print medium and is communicably connected to a computer 110 that is an external apparatus. In addition, the embodiment is described using a medium (a roll-shaped medium, hereinafter, particularly referred to as a rolled sheet S (a continuous sheet)) such as a sheet which is rolled in a roll shape, as an example of the print medium on which the printer 1 prints an image.

Furthermore, the printer 1 according to the embodiment is a so-called label printer and the printer 1 prints a plurality of labels (equivalent to unit images) as images (that is, the same labels are repeatedly printed).

A printer driver is installed on the computer 110. The printer driver is recorded in a recording medium (a computer-readable recording medium) such as a flexible disk FD or a CD-ROM. Otherwise, it is possible to download the printer driver to the computer 110 through the Internet. In addition, the program is configured of codes for realizing various functions.

Then, in order to print the label (unit image) with the printer 1, the computer 110 outputs a print job to the printer 1 corresponding to the label (unit image) to be printed.

The printer 1 of the embodiment is an apparatus which prints the label (unit image) on the print medium by ejecting an ultraviolet ray-curable ink (hereinafter, UV ink) which is cured by radiation of ultraviolet rays (hereinafter, UV), as an example of ink. The UV ink is ink including an ultraviolet ray-curable resin and is cured by an occurrence of photo polymerization reaction in the ultraviolet ray-curable resin when receiving the radiation of the UV. In addition, the printer 1 of the embodiment prints the image using the UV inks of four colors of cyan, magenta, yellow and black.

The printer 1 has a transportation unit 20, a head unit 30, an irradiation unit 40, a detector group 50 and a controller 60 (here, the head unit 30 and the controller 60 are equivalent to a printing section). The printer 1 receiving the print job from the computer 110 that is the external apparatus prints the label (unit image) on the rolled sheet S depending on the print job by controlling each unit (the transportation unit 20, the head unit 30 and the irradiation unit 40) using the controller 60. The controller 60 controls each unit and prints the label (unit image) on the rolled sheet S, based on the print job received from the computer 110. Situations inside the printer 1 are monitored by the detector group 50 and the detector group 50 outputs a detection result to the controller 60. The controller 60 controls each unit, based on the detection result output from the detector group 50.

The transportation unit 20 transports the rolled sheet S along a predetermined transportation path set in advance. As illustrated in FIG. 2, the transportation unit 20 has a reel-out shaft 201 on which the rolled sheet S is wound and is rotatably supported, a relay roller 21, a first transportation roller 22, a relay roller 23, a reverse roller 24, an abutting roller 25, a transportation drum 26, a tension roller 27, a second transportation roller 28, a tension roller 29, and a rolled sheet rewind driving shaft 202 which rewinds the rolled sheet S passing through the tension roller 29.

The relay roller 21 is a roller which winds and holds the rolled sheet S which is reeled out from the reel-out shaft 201 from a lower side (left lower side in the drawing) and transports the rolled sheet S to the right side in a horizontal direction.

The first transportation roller 22 has a first driving roller 22*a* which is driven by a motor (not illustrated) and a first driven roller 22*b* disposed so as to face the first driving roller 22*a* across the rolled sheet S. Position control or speed control of the rolled sheet S is performed by driving the first driving roller 22*a*.

The relay roller 23 is a roller which winds and holds the rolled sheet S which passes through the first transportation roller 22 from the left side in the horizontal direction and transports the rolled sheet S to the right lower side.

The reverse roller 24 is a roller which reverses the transportation direction of the rolled sheet S which passes through the relay roller 23.

The abutting roller 25 is a roller which winds and holds the rolled sheet S which passes through the reverse roller 24 from the vertically lower side and sends the rolled sheet S to the transportation drum 26.

The transportation drum 26 is a cylindrical transportation member, supports the rolled sheet S on a peripheral surface thereof, and transports the rolled sheet S in the transportation direction. In addition, the transportation drum 26 faces a head 31 and an irradiation section 41 described below through the rolled sheet S. In addition, the rolled sheet S is transported so as to closely contact the transportation drum 26 with a predetermined tension.

The tension roller 27 is provided on a right lower side of the transportation drum 26 and sends the rolled sheet S to the second transportation roller 28 by reversing the transportation direction of the rolled sheet S which passes through the transportation drum 26.

The second transportation roller 28 has a second driving roller 28*a* which is driven by a motor (not illustrated) and a second driven roller 28*b* which is disposed so as to face the second driving roller 28*a* across the rolled sheet S. The second transportation roller 28 is a roller transporting a portion of the rolled sheet S after the image is recorded by each head 31.

The tension roller 29 is a roller which winds and holds the rolled sheet S which passes through the second transportation roller 28 from left side in the horizontal direction, and then transports the rolled sheet S to the rewind driving shaft 202 which is present on the lower side in the vertical direction.

As described above, a transportation path for transporting the rolled sheet S is formed by moving the rolled sheet S through each roller successively.

The head unit 30 ejects the UV ink on the rolled sheet S. The head unit 30 forms dots on the rolled sheet S and prints the label (unit image) on the rolled sheet S by ejecting the UV ink from each head 31 with respect to the rolled sheet S during transportation in a transportation direction.

Furthermore, each head 31 of the head unit 30 of the printer 1 of the embodiment can form dots for a sheet width of the rolled sheet S simultaneously. That is, the head 31 is a so-called line head. Therefore, the head 31 has a long shape in a width direction (a direction passing through a plane of a sheet of FIG. 2) of the sheet that is an intersecting direction intersecting the transportation direction, and nozzles are arranged in the width direction of the sheet. Then, the head 31 prints a raster line sequentially (repeatedly) by ejecting the UV ink from the nozzles onto the rolled sheet S that is transported by the transportation unit 20 (therefore, a plurality of raster lines are arranged in the transportation direction).

Moreover, a piezoelectric element (not illustrated) is provided in the nozzles as a driving element for ejecting ink droplets. The piezoelectric element expanses depending on an application time of a voltage and deforms a side wall (a vibration plate) of a flow path of the UV ink if the voltage of predetermined duration of time is applied between electrodes provided at both ends thereof. Therefore, a volume of the flow path of the ink is contracted according to the expansion and contraction of the piezoelectric element and the ink corresponding to the contraction is ejected from the nozzles in forms of the ink droplets.

In addition, as described above, in the embodiment, four color UV inks for forming the label (unit image) are used as the UV inks. As illustrated in FIG. 2, in order from the upstream side in the transportation direction, each head 31 of a cyan ink head 32 for ejecting the UV ink of cyan, a magenta ink head 33 for ejecting the UV ink of magenta, a yellow ink head 34 for ejecting the UV ink of yellow, and a black ink head 35 for ejecting the UV ink of black are provided so as to face the peripheral surface of the transportation drum 26.

The irradiation unit 40 radiates the UV toward the UV ink landed on the rolled sheet S. The dots formed on the rolled sheet S are cured by receiving the radiation of the UV from the irradiation unit 40. The irradiation unit 40 of the embodiment includes the irradiation section 41. In addition, the irradiation section 41 includes a lamp (a metal halide lamp, a mercury lamp or the like) of a LED as a light source of the UV radiation.

The irradiation section 41 is provided on the downstream side of the black ink head 35 in the transportation direction. In other words, the irradiation section 41 is provided on the downstream side of the head unit 30 in the transportation direction. Thus, the irradiation section 41 cures the dots by radiating the UV on the unit image (dot) formed on the rolled sheet S by the cyan ink head 32, the magenta ink head 33, the yellow ink head 34 and the black ink head 35.

The detector group 50 includes a rotary type encoder or the like. The rotary type encoder detects an amount of the rotation of the first driving roller 22*a* or the second driving roller 28*a*.

It is possible to detect an amount of the transportation of the medium, based on a detection result of the rotary type encoder.

The controller 60 is a control unit (a control section) for performing control of the printer 1. The controller 60 has an I/F section 61, a CPU 62, a memory 63, a unit control section 64 and a user interface section 65 (equivalent to a relevant information selecting section and a color designation section). The I/F section 61 performs transmitting and receiving the data between the computer 110 that is the external apparatus and the printer 1. The CPU 62 is an arithmetic processing unit for performing control of an entire printer. The memory 63 is intended to ensure an area for storing the program of the CPU 62 or a working area, and has a memory element such as RAM and EEPROM. The CPU 62 controls each unit through the unit control section 64 according to the program stored in the memory 63. The user interface section 65 is intended to interface with the user and is configured of an input section such as a touch panel, an output section such as a monitor, an input and output process section for processing data which are input and output, or the like.

Printing Process

Figure 3:
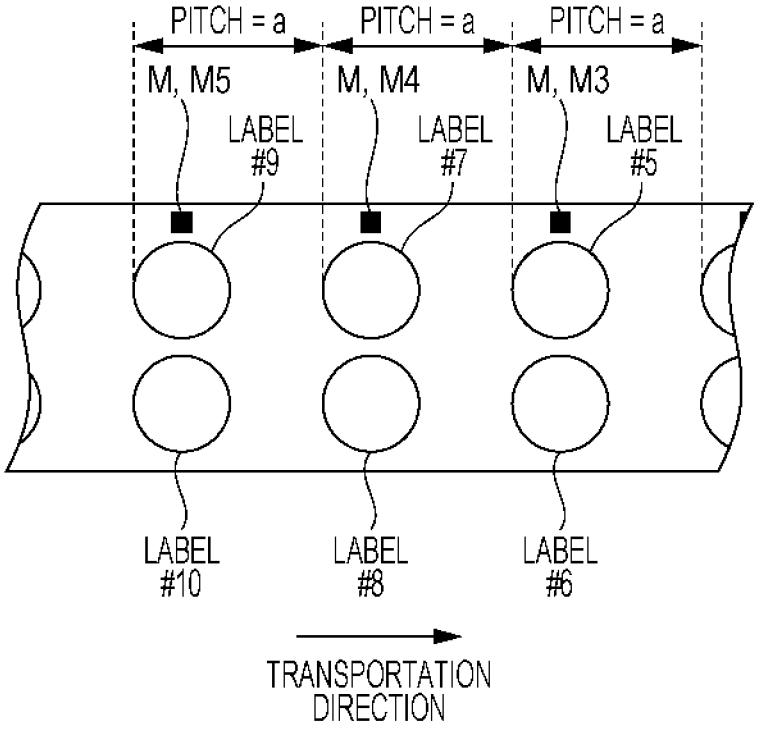
FIG. 3 is a schematic view illustrating a state where a label (a unit image) is printed on a rolled sheet.

Here, a printing process of the printer 1 is described with reference to FIG. 3. FIG. 3 is a schematic view illustrating a shape when the label (unit image) is printed on the rolled sheet S.

Moreover, the printing process is realized by the controller 60. Particularly, in the embodiment, the printing process is realized by processing the program stored in the memory 63 by the CPU 62. Then, the program is configured of a code for performing various operations described below.

When the printer 1 starts printing, the rolled sheet S is disposed on the transportation path in a state where the rolled sheet S is along the peripheral surface of the transportation drum 26 in advance. Then, the tension is applied to the rolled sheet S by an output torque of the reel-out shaft 201, the rewind driving shaft 202 and the second transportation roller 28. Particularly, a predetermined tension is given to the reel-out portion of the rolled sheet S by a brake torque of the reel-out shaft 201 depending on the roll diameter of the rolled sheet S. The tension is detected with the tension roller 27 and the torque of a motor (not illustrated) of the second transportation roller 28 is controlled so as to give a predetermined tension in the portion of the printing area. The tension is detected with the tension roller 29 and the torque of a motor (not illustrated) of the rewind driving shaft 202 is controlled so as to give a predetermined tension in the portion of the printing area. In the rewind section, the tension is detected with the tension roller 29 and the torque of a motor (not illustrated) of the rewind driving shaft 202 is controlled so as to be a predetermined tension. Each tension is determined depending on the roll diameter of the rolled sheet S.

When the printer 1 receives the print job from the computer 110, the controller 60 rotates a motor (not illustrated) of the first transportation roller 22. As described above, in a state where the tension is applied to the rolled sheet S, the rolled sheet S is transported in the transportation direction by rotating the first transportation roller 22.

Moreover, the transportation drum 26 is rotated in an arrow direction (transportation direction) following the transportation of the rolled sheet S by a friction force with the rolled sheet S. The rolled sheet S on the peripheral surface of the transportation drum 26 is transported in the transportation direction depending on the rotation of the transportation drum 26. In addition, the rolled sheet S in the middle of transportation closely comes in contact with the transportation drum 26. In the embodiment, since the position of each head 31 during printing is fixed, each head 31 and the rolled sheet S are relatively moved in the transportation direction by transporting the rolled sheet S in the transportation direction.

Then, each head 31 of the head unit 30 forms a label (unit image) on the rolled sheet S by ejecting the UV ink on the rolled sheet S that is transported by the transportation unit 20. Further, when the label (unit image) which is formed reaches a position facing the irradiation section 41 by the transportation, the irradiation unit 40 radiates the UV to the label (unit image) and cures the UV ink on the rolled sheet S.

Then, as illustrated in FIG. 3, a plurality of labels (unit images) are printed on the rolled sheet S by the processing described above. In the embodiment, the plurality (two) of circular labels (hereinafter, two labels are also referred to as a label group) arranged in the width direction of the sheet are repeatedly printed in the transportation direction.

Further, the controller 60 (the head unit 30) forms the plurality of labels (unit images) on the rolled sheet S and forms a so-called eye mark M. The eye mark M is a mark as a reference for specifying (when specifying) a position of the label (unit image) and, in the embodiment, is an alignment mark to align the position of the label in a post-processing machine (different from the printer 1) for cutting the label (unit image). Then, as illustrated in FIG. 3, the controller 60 (the head unit 30) forms the eye mark M corresponding to each label (in other words, the label group).

Moreover, in FIG. 3, a state where the labels from a 5th label (the label number is 5) to a 10th label (the label number is 10) are formed is illustrated. In the example, since the sequence number of the label in the width direction of the sheet is 2, the 5th label and a 6th label are the labels on a 3rd row (the labels in which the row number is 3), a 7th label and an 8th label are the labels on a 4th row (the labels in which the row number is 4), and a 9th label and a 10th label are the labels on a 5th row (the labels in which the row number is 5).

Then, a 3rd eye mark M3 (the eye mark in which the eye mark number is 3) is formed corresponding to the 5th and 6th labels (the labels of the 3rd row), a 4th eye mark M4 (the eye mark in which the eye mark number is 4) is formed corresponding to the 7th and 8th labels (the labels of the 4th row), and a 5th eye mark M5 (the eye mark in which the eye mark number is 5) is formed corresponding to the 9th and 10th labels (the labels of the 5th row).

Eye Mark M According to Embodiment

For the color of the eye mark M according to the related art, monochrome such as black is sufficient to perform function thereof and, typically, the eye mark M is a monochrome image (for example, one that is a black square).

On the other hand, the eye mark M according to the embodiment has the following characteristics different from those of the related art. That is, the eye mark M according to the embodiment includes an image (for the sake of convenience, referred to as a different-color image) that can be visually recognized ("visually recognized" means that it is possible to understand the image with eyes of a person) of which a color is different from a background color (the background color means a color of the background of the different-color image in the eye mark M. In other words, the background color means a color of a portion other than the different-color image of the eye mark M) of the eye mark M. Then, the different-color image is the information (for the sake of convenience, referred to as relevant information) relating the label (unit image).

Figure 4:
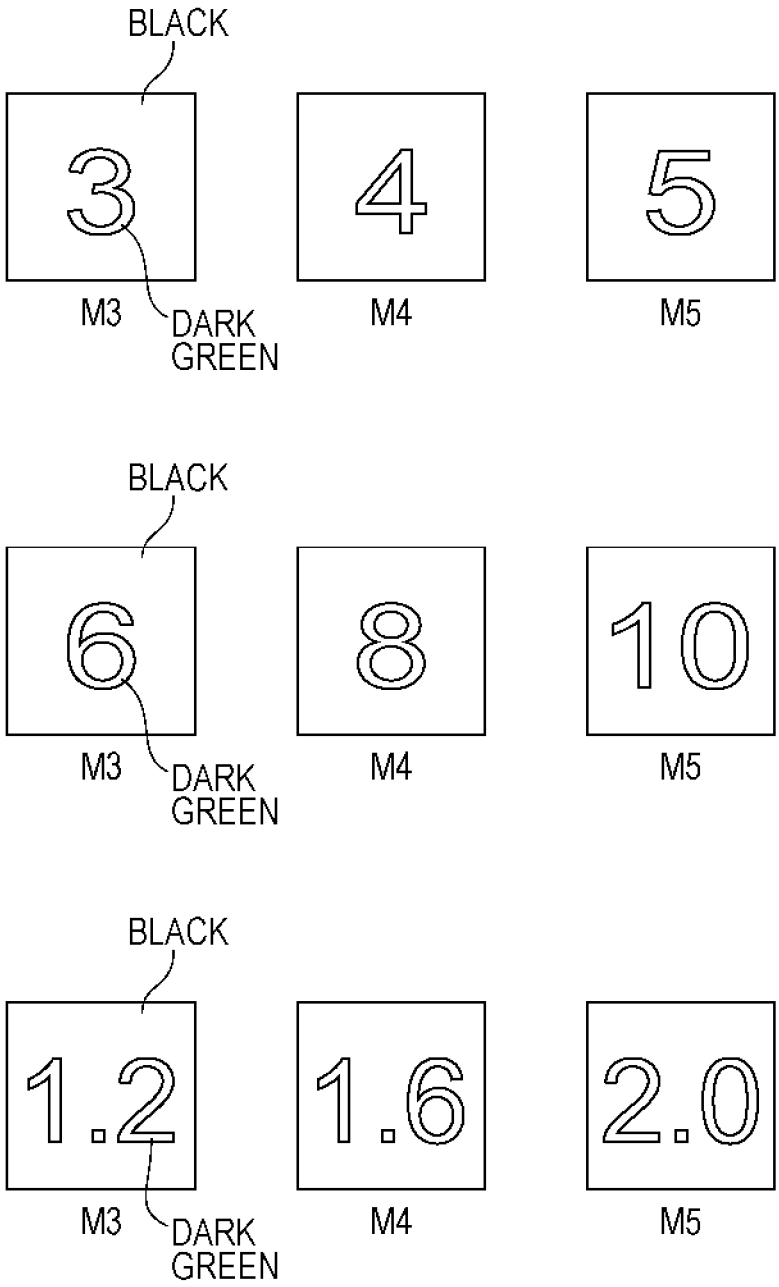
FIG. 4 is an enlarged schematic view illustrating states of eye marks illustrated in FIG. 3.

Particularly, description of the eye mark M is given with reference to FIG. 4. FIG. 4 is an enlarged schematic view illustrating a state of the eye mark M3 to the eye mark M5 illustrated in FIG. 3.

An upper view of FIG. 4 illustrates an example the row number of the label formed as the different-color image (the relevant information). That is, in the example, the images (the images of 3, 4, and 5) that can be visually recognized are included in the eye marks M. Then, the image (the different-color image) has a dark green and is a different color from the black background image. Then, the different-color image is the row number that is one of the relevant information relating to the label (unit image). Moreover, the row number of the label is the same as the eye mark number of the eye mark M, it can be said that this view also forms the eye mark number as the different-color image.

A center view of FIG. 4 illustrates an example in which the label number of the label is formed as the different-color image (the relevant information). That is, in the example, the images (the images of 6, 8 and 10) that can be visually recognized are included in the eye marks M. Then, the image (the different-color image) has the dark green color and is the color different from the dark background image, similar to the upper view of FIG. 4. Then, the different-color image is the label number that is one of the relevant information relating to the label (unit image).

Moreover, in the example, the label number of the label that has a greater number among the two labels (unit images) arranged in the width direction of the paper sheet is formed, but the label number of the label that has a smaller number among the two labels (unit images) may be formed (in such a case, it is 5, 7, and 9 instead of 6, 8 and 10). Further, the label numbers of both labels may be formed (in such a case, it is 5, 6, 7, 8, 9, and 10).

A lower view of FIG. 4 illustrates an example in which a label position (for example, the label is printed in a point that is how many meters away from the beginning of the rolled sheet S) in which the label (unit image) is positioned in the transportation direction as the different-color image (the relevant information). That is, in the example, the images (the images of 1.2, 1.6, and 2.0) that can be visually recognized are included in the eye mark M. Then, the image (the different-color image) has the dark green color and is the color different from the dark background image, similar to the upper view of FIG. 4. Then, the different-color image is the label position that is one of the relevant information relating to the label (unit image).

As described above (as illustrated in FIG. 4), in the example, the information relating to the label (unit image) is embedded in the eye mark M with the intent to improve the convenience for the user (that is, the wanted information regarding the label (unit image) on which the user focuses is the following: the label number, the label row number, or how many meters that the label is positioned away).

Further, in the embodiment, it is possible to change which one among the row number, the label number, and the label position is included in the eye mark M (which one is embedded in the eye mark M). That is, the user interface section 65 described above includes a function for the user to select the relevant information (one among the three candidates) among candidates of a plurality of relevant information (in the embodiment, the row number, the label number, and the label position), and the controller 60 (the head unit 30) is adapted to form the eye mark M including the relevant information which is selected by the user as the different-color image on the rolled sheet S. Moreover, the selection of the relevant information is described below in detail.

Further, the above description is given in which the color of the different-color image is dark green and the background color is black, but strictly speaking, the both colors are colors in which L values are the same as each other and at least one of an a value and a b value is different from each other in a Lab color space (in terms of specific numerical values, for Lab of the background color=(10, 5, 4) and Lab of the color of different-color image=(10, −128, 4)). Moreover, the reason why the L values are the same as each other and only the a value or the b value is changed is described below.

Further, in the embodiment, the color of the different-color image can be changed. That is, the user interface section 65 described above has the function for the user to designate at least one of the a value and the b value, and the controller 60 (the head unit 30) is adapted to form the eye mark M including the different-color image of the color which is designated by the user on the rolled sheet S. Moreover, the designation of the color is also described below in detail.

Selection of Relevant Information and Designation of Color

As described above, if the printer 1 receives the print job from the computer 110, the controller 60 starts printing. Then, in the embodiment, since the eye mark M is not given to the print job, first, the controller 60 generates the eye mark M including the different-color image (the relevant information described above).

Moreover, the user, in advance, instructs the user interface section 65 to generate which eye mark M of different-color images (the relevant information). That is, as described above, the user selects the relevant information to be added to the eye mark M among a plurality of candidates (the row number, the label number and the label position).

FIG. 5 is a view illustrating an example of a user interface screen relating to the selection of the relevant information. The user selects one of the row number, the label number and the label position by selecting a radio button.

Further, the user designates at least one of the a value and the b value.

FIG. 6 is a view illustrating an example of the user interface screen relating to the designation of the color. As illustrated in FIG. 6, in the embodiment, the user comes to choose one of four choices about how to change the a value and the b value of the background color of the eye mark M to make the color of the different-color image (relevant information), and the user selects one of the four choices. For example, if the user selects the choice 2 in FIG. 6, the Lab of the different-color image=(10, −128 and 4) while Lab of the background color=(10, 5 and 4).

Moreover, in the embodiment, only one of the a value and the b value is designated, but both may be designated. Further, only two types of values (the maximum value and the minimum value) may be designated as any one of the a value and the b value, but the user may designate the values freely (the user may input the a value and the b value directly).

Then, the relevant information and the color information are stored in the memory 63. Moreover, the following information (for the sake of convenience, referred to as the eye mark information) relating to the eye mark M is stored in the memory 63 in advance. That is, relative position information of the eye mark M with respect to the label (unit image), size information of eye mark M, and the background color information of eye mark M are stored. However, the eye mark information may be also selected by the user.

Then, the controller 60 generates the eye mark M including the different-color image (the relevant information), based on the information (the relevant information, the color information, and the eye mark information) stored in the memory 63.

For example, if the relevant information that is selected is the row number, the image is generated from 1 in order of 1, 2, 3, . . . .

Further, if the relevant information that is selected is the label number, a value of two times the case of the row number is generated in order. That is, the image is generated from 2 in order of 2, 4, 6, . . . . Moreover, that two times is based on the arrangement number of the label (unit image) in the width direction of the sheet and the arrangement number can be grasped by analyzing contents of the print job which is delivered from the computer 110.

Further, if the relevant information that is selected is the label position, the value of a times of the case of the row number is generated in order. Here, as illustrated in FIG. 3, the numeral value a is a positional difference (pitch) in the transportation direction of two labels (unit images) adjacent to each other and the pitch can also be grasped by analyzing the contents of the print job. For example, if a=0.4, the image is generated from 0.4 in order of 0.4, 0.8, 1.2, . . . (moreover, the value of the label position according to the embodiment is an approximately calculated value).

Then, the eye mark M with the different-color image (the relevant information) is generated by applying the image that is generated as described above to the eye mark M (at this time, the color information and the eye mark information are referred).

Then, the controller 60 imposes the eye mark M with the different-color image (the relevant information) that is generated in a predetermined position of the printing data and creates the printing data with the eye mark M. Then, the controller 60 (the head unit 30) performs the printing, based on the printing data.

Effectiveness of Printer 1 According to Embodiment

As described above, the printer 1 according to the embodiment has the printing section that forms the plurality of labels (unit images) on the rolled sheet S and forms the eye mark M that is the reference for specifying the position of the label (unit image) on the rolled sheet S. Then, eye mark M includes the different-color images that can be visually recognized of which the color is different from the background color of the eye mark M. Thus, it is possible to realize the printer 1 having high user convenience.

That is, as described above, sometimes, the user desires that the user assist information is printed on the rolled sheet S. For example, the wanted information regarding the label (unit image) on which the user focuses is the following: the label number, the label row number, or how many meters that the label is positioned away.

However, there is a concern that design of the label (unit image) may be damaged if such information is printed on the label (unit image).

Further, the eye mark M is printed outside the label (unit image), but if such information is also printed outside the label (unit image), the image besides the label (unit image) that is printed outside the label (unit image) increases, and the appearance of the rolled sheet S is not good after the printing is completed. Further, there is a concern that the image on which the information is printed may be frequently and falsely detected as the eye mark M in the post-processing machine.

As described above, in any case, undesirable situation for the user occurs, therefore, a new strategy having high convenience is requested for the user.

Meanwhile, the printer 1 according to the embodiment meets such request. That is, in the embodiment, since the eye mark M includes the different-color images that can be visually recognized of which the color is different from the background color of the eye mark M, it is possible to embed the information described above in the different-color image.

Then, in such a case, since the design of the label (unit image) is not damaged and the image besides the label (unit image) that is printed outside the label (unit image) does not increase, the appearance of the rolled sheet S may not be deteriorated after the printing is completed. Further, it is also possible to suppress the occurrence of false detection if the color of the different-color image is devised.

Therefore, according to the embodiment, it is possible to realize the printer 1 having high user convenience.

Further, the printer 1 according to the embodiment described above includes the user interface section 65 that makes the user select the relevant information among the candidates of the plurality of relevant information and the controller 60 (the head unit 30) is adapted to form the eye mark M including the relevant information that is selected by the user as the different-color image on the rolled sheet S. Thus, it is possible to further improve the convenience for the user.

Other Embodiments

The above embodiment is intended to facilitate the understanding of the invention and is not intended to limit the invention. The invention can be altered and improved without deviating from the spirit thereof, and it goes without saying that equivalents thereof are included in the invention. Particularly, embodiments described below are also included in the invention.

In the above embodiment, the rolled sheet S is described as an example of the print medium but the invention is not limited to the sheet, and for example, the medium may be film or cloth.

In the above embodiment, the liquid ejecting apparatus is described as an example of the printing apparatus but the invention is not limited to the liquid ejecting apparatus, and the printing apparatus may be any apparatus if the apparatus has the printing function.

Further, the liquid ejecting apparatus is embodied as the ink jet type printer, but a liquid ejecting apparatus may be employed to eject a liquid other than the ink. The invention may be applied to various types of liquid ejecting apparatuses including a liquid ejecting head or the like ejecting small amount of liquid droplets. In addition, liquid droplets are referred to as states of the liquid ejected from the liquid ejecting apparatus described above and also include liquids trailing in granular shape, a tear shape and a thread shape. In addition, the liquid referred to herein may be a material which can be ejected from the liquid ejecting apparatus. For example, a material may be used as long as the material is in a state of a liquid phase. In addition, the material includes liquid material having high or low viscosity, a flow-shape body such as sol, gel water, inorganic solvent, organic solvent, solution, liquid-shaped resin, liquid-shaped metal (melt metal), and not only the liquid as one state of a material but also a material in which particles of functional material consisted of solids such as pigments or metal particles is dissolved, dispersed or mixed in a solvent. In addition, a representative example of the liquid includes the ink described in the above embodiment, liquid crystal or the like. Here, the ink is intended to include various types of liquid compositions such as general water-based ink, oil-based ink, gel ink and hot melt ink. A specific example of the liquid ejecting apparatus includes, for example, a liquid ejecting apparatus ejecting liquid including in a form of dispersion or dissolution such as an electrode material or a color material that is used to manufacture a liquid crystal display, an electroluminescence (EL) display, a surface emitting display and a color filter. Otherwise, the liquid ejecting apparatus may be a liquid ejecting apparatus ejecting a bioorganic material used for biochip manufacturing, a liquid ejecting apparatus ejecting liquid which is a sample used as a precision pipette, a printing apparatus, a micro-dispenser or the like. Furthermore, the liquid ejecting apparatus may employ a liquid ejecting apparatus ejecting lubricant at a pin point to a precision machine such as a watch or a camera, a liquid ejecting apparatus ejecting transparent resin liquid such as a ultraviolet curing resin to form a micro hemispherical lens (an optical lens) used for an optical communication device or the like on a substrate, and a liquid ejecting apparatus ejecting etching liquid such as acid or alkali to etch a substrate or the like. Then, the invention may be applied to any one of the liquid ejecting apparatuses.

Further, in the embodiment described above, the shape of the label (unit image) is circular, but the invention is not limited to the embodiment and the label may be any shape. For example, the label may be rectangular.

Further, in the embodiment described above, the number of the labels (unit images) arranged in the width direction of the sheet is two, but the invention is not limited to the embodiment and for example, the number of labels may be one or three or more.

Further, in the embodiment described above, the different-color image represents the relevant information relating to the label (unit image), but the invention is not limited to the embodiment. For example, a memo or the like may be embedded in eye mark M as the different-color image by the user.

Further, in the embodiment described above, in the colors of the background color and the different-color image, the L value is the same as each other and at least one of the a value and the b value is different from each other in the space of Lab color, but the invention is not limited to the embodiment. For example, the L value may be changed.

However, the embodiment described above is preferable in that occurrence of the false detection can be suppressed by using a general-purpose post-processing machine including an eye mark reading sensor that senses, based on the brightness of the eye mark M, if the L values of the background color and the different-color image are not changed.

Further, in the embodiment described above, the user interface section 65 that makes the user designate at least one of the a value and the b value is included and the controller 60 (the head unit 30) forms the eye mark M including the different-color image of the color that is designated by the user on the rolled sheet S, but the invention is not limited to the embodiment, and the color of the different-color image may not be changed by the user.

However, if the change can be performed by the user, the user can designate the color of the different-color image in which the occurrence of the false detection is minimized (for example, the user surveys frequency of the false detections while changing the color of the different-color image and can designate the color having minimum frequency, based on survey results). In this regard, the embodiment described above is preferable.

Figure 7:
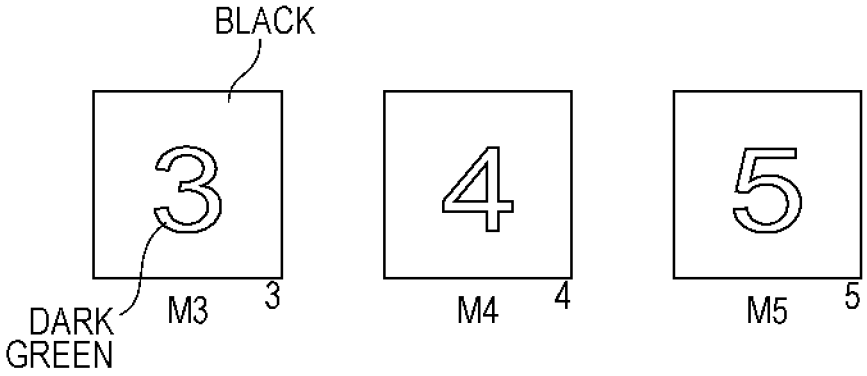
FIG. 7 is an enlarged schematic view according to a modification example illustrating states of eye marks illustrated in FIG. 3.

Further, as illustrated in FIG. 7, the information (for example, the relevant information relating the label (unit image)) similar to the different-color image may be formed in a position adjacent to the eye mark M. In such a case, the wanted information regarding the label (unit image) on which the user focuses can be the following: the label number, the label row number, or how many meters that the label is positioned away. Further, since the information is adjacent to the eye mark M, the occurrence of the false detection is not remarkable and the appearance also does not worse so much. Moreover, FIG. 7 is a view corresponding to the upper view of FIG. 4 and is an enlarged schematic view according to a modification example in which the eye mark M3 to the eye mark M5 illustrated in FIG. 3 are illustrated.

Further, in the embodiment described above, the embodiment in which the relevant information is given to the whole eye marks, but the invention is not limited to the embodiment and the same effects are obtained even though the relevant information is given to every other eye marks, every ten eye marks and every hundred eye marks. For example, if the relevant information is given to every hundred eye marks, the same label is printed from 1 to 99 and the label which is different in the eye mark portion is printed only on the 100th eye mark. Therefore, it is possible to reduce processing load that prints the label which is different in every print.

The entire disclosure of Japanese Patent Application No. 2013-068836, filed Mar. 28, 2013 is expressly incorporated by reference herein.

What is claimed is:

1. A printing apparatus comprising:

a printing section that forms a plurality of unit images on a print medium and forms marks that are references for specifying positions of the unit images on the print medium; and a user interface section configured to receive input from a user, wherein the input is added to the marks as a different-color image that is configured to be interpreted visually;

wherein the different-color image capable of being visually recognized, wherein a color of the different-color image is different from a background color of the marks.

2. The printing apparatus according to claim 1, wherein the different-color image is relevant information relating to the unit images.

3. The printing apparatus according to claim 2, wherein the user interface section further comprises:

a relevant information selecting section that makes the user select the relevant information among candidates of a plurality of pieces of relevant information, wherein the printing section forms the marks including the relevant information that is selected by the user as the different-color image on the print medium.

4. The printing apparatus according to claim 1, wherein, in colors of the background color and the different-color image, L values are the same as each other, and at least one of an a value and a b value is different from each other, in a space of Lab color.

5. The printing apparatus according to claim 4, further comprising:

a color designation section that makes the user designate at least one of the a value and the b value, wherein the printing section forms the marks including the different-color image of which the color is selected by the user on the print medium.

* * * * *